US006205666B1

(12) United States Patent
Junk

(10) Patent No.: US 6,205,666 B1
(45) Date of Patent: Mar. 27, 2001

(54) DRY SHAVING APPARATUS

(75) Inventor: Peter Junk, Schmitten (DE)

(73) Assignee: Braun GmbH, Frankfurt (DE)

( * ) Notice: Subject to any disclaimer, the term of this patent is extended or adjusted under 35 U.S.C. 154(b) by 0 days.

(21) Appl. No.: 09/202,761

(22) PCT Filed: Jun. 26, 1997

(86) PCT No.: PCT/EP97/03365

§ 371 Date: Dec. 21, 1998

§ 102(e) Date: Dec. 21, 1998

(87) PCT Pub. No.: WO98/06546

PCT Pub. Date: Feb. 19, 1998

(30) Foreign Application Priority Data

Aug. 10, 1996 (DE) ..... 196 32 333

(51) Int. Cl.[7] ..... B26B 19/04
(52) U.S. Cl. ..... 30/43.92; 30/346.51
(58) Field of Search ..... 30/43.92, 346.51, 30/43.9, 43.6

(56) References Cited

U.S. PATENT DOCUMENTS 4,271,590 * 6/1981 Ernst et al. ..... 30/43.92

FOREIGN PATENT DOCUMENTS

213581 * 10/1956 (AU) ..... 30/43.92
822 361 11/1951 (DE) .
33 02 610 8/1984 (DE) .
42 15 398 12/1992 (DE) .
44 10 543 C1 12/1994 (DE) .
0 161 508 11/1985 (EP) .
0 580 250 1/1994 (EP) .

* cited by examiner

*Primary Examiner*—Douglas D. Watts
(74) *Attorney, Agent, or Firm*—Fish & Richardson P.C.

(57) ABSTRACT

The invention is directed to a dry shaving apparatus having a housing (1) and a housing portion (21) in which at least one exchangeable frame (20) incorporating at least one cutting element (18) is held by at least one detent means (28, 29), with cooperating stop elements (40, 50, 60, 70) being provided on the exchangeable frame (20) and on the housing portion (21), wherein the stop elements (40, 50, 60, 70) are maintained in engagement by means of at least one pressure element (30, 31) acted upon by a spring element (32, 33) and bearing against a wall (39), and by means of a sloping wall surface (34, 35, 36, 37) acted upon by the pressure element (30, 31), and wherein the pressure element (30, 31) and the sloping wall surface (34, 35, 36, 37) are provided to take effect only on one side of the cooperating stop elements (40, 50, 60, 70).

20 Claims, 3 Drawing Sheets

DRY SHAVING APPARATUS

This invention relates to a dry shaving apparatus.

A dry shaving apparatus of the type initially referred to is known from printed specification DE 33 02 610 A1. The exchangeable frame disposed in a shaving head frame sits, by means of a flange, on the ledge of the apparatus housing and is attached thereto by a positive-engagement latch mechanism which is formed by projections engaging within recesses and acts in both working directions of the cutter head.

A housing portion which is intended to receive and mount an exchangeable frame may be disposed on the housing of a dry shaving apparatus releasably—see DE 33 02 610 A1—or, alternatively, it may be solidly joined together with the housing, meaning that it constitutes part of the housing—see DE 44 105 43 (C1), FIG. 10.

Positive-engagement connections between an exchangeable frame and a housing portion of a dry shaving apparatus for the purpose of obtaining a vibration-free seat of the exchangeable frame require an engagement of cooperating positive-engagement elements that is free from relative movement, that is, a clearance-free positive engagement. This necessarily involves increased manufacturing expense, the more so since the components, such as the exchangeable frame and the housing portion, which are equipped with cooperating positive-engagement elements are manufactured in different dies needing to be matched with great precision. Considering that the exchangeable frame is removed from, and placed back onto, the housing portion after each shave in order to clean the cutting elements, abrasion and/or deformation necessarily occurs on the cooperating positive-engagement elements. In addition, sebum and hair dust settle on the positive-engagement elements, causing increased abrasion and deformation of the positive-engagement elements typically made of plastic. Then air gaps may occur between the positive-engagement elements in manufacture, particularly however later in operation of the dry shaving apparatus, and while these gaps are initially relatively small, they tend to become wider due to, for example, vibration of the housing, vibration of the cutting elements and other loads, eventually causing the exchangeable frame in the housing portion to covibrate correspondingly. Covibration of an exchangeable frame equipped with at least one cutting element is known to impair the cutting effect of the cooperating cutting elements provided, in addition to producing an undesired, relatively loud rattling noise.

It is an object of the present invention to ensure, in a dry shaving apparatus of the type initially referred to, a lasting vibration-free seat of the exchangeable frame in a housing portion.

This object is accomplished in a dry shaving apparatus embodying the invention.

A substantial advantage of the present invention resides in that the stop elements provided on both the exchangeable frame and the housing portion, under the action of the spring-loaded pressure elements, are moved automatically into abutting engagement with a sloping wall surface during the process of attaching the exchangeable frame to the housing portion and are maintained in engagement therewith, and the effect of the spring element acting through the pressure elements on the sloping wall surface is dimensioned such that a permanent engagement of the cooperating stop elements withstands any loads that may occur in operation of the dry shaving apparatus.

The present invention enables the manufacturing tolerances of the components governing the cooperative relationship of exchangeable frame to housing portion to be amply dimensioned, because it utilizes the range of action of a tensed spring element to compensate for any clearance—resulting, for example, from attrition and/or deformation among other causes—between the stop elements and the pressure elements, hence ensuring a clearance-free engagement of the stop elements at all times. This facilitates the manufacture of exchangeable frame and housing portion and, in consequence, reduces the manufacturing cost.

According to an embodiment of the present invention, at least one stop element is provided on a transverse wall of the housing portion. For the purpose of attaching the exchangeable frame to the housing portion, it is sufficient in accordance with an embodiment of the present invention to provide a stop element on at least one of the longitudinal sides of the exchangeable frame. In an embodiment of the invention it is, however, of particular advantage to arrange one stop element each on each of the two longitudinal sides of the exchangeable frame. This enables the exchangeable frame to be attached to the housing portion either way. A congruent arrangement of the stop elements on the longitudinal sides of the exchangeable frame and the longitudinal sides of the transverse walls of the housing portion ensures at least equally an attachment either way and, beyond that, a force-balanced engagement of the exchangeable frame with the housing portion.

In an embodiment of the present invention, the stop elements have abutment surfaces extending parallel to the direction of force of the spring element. In another aspect of this embodiment, provision is made for the direction of force of the spring element to be oriented parallel to the vertical center line M—direction of arrow A—of the dry shaving apparatus.

The direction in which the sloping wall surface extends relative to the direction of force of the spring element is determined by the angle $\alpha$. The smaller the angle $\alpha$, the greater the necessary range of action of the pressure element. A small angle $\alpha$ enables a weaker dimensioning of the spring element, with the attendant advantage of a small overall size of the spring element and reduced demands on the stability of the abutment for the spring element. A low force of the spring element has the advantage that the additional energy to be expended by the arrangement of the invention is kept low as the exchangeable frame is seated down onto the housing portion.

In an embodiment of the present invention, the sloping wall surface extends at an angle $\alpha$ of 3°–45° relative to the direction of force of the spring element—direction of arrow A. In a preferred embodiment of the present invention, the angle $\alpha$ is provided in an angular range of 15°±5°. In this connection it is to be remembered that the use of an angle $\alpha$ that lies below or in the range of the angle of friction dependent on the pairing of the materials of pressure element and sloping wall surface requires that the pressure element be constructed as a rolling element because otherwise jamming occurs when the exchangeable frame is seated in place.

In a preferred embodiment of the present invention, at least one pressure element acted upon by a spring element is provided in one of the walls of two adjacent wall surfaces of the exchangeable frame and the housing portion. In a further aspect of this embodiment, two pressure elements each acted upon by a spring element are provided in an end wall of the housing portion. In an embodiment of the present invention differing therefrom, two pressure elements acted upon by only one spring element are arranged in an end wall of the housing portion. In an alternative embodiment of the invention, at least one pressure element acted upon by a spring element is provided in a sloping wall surface of the exchangeable frame.

In a preferred embodiment of the present invention, the sloping wall surface is provided on the exchangeable frame. A particularly simple embodiment is characterized in that the sloping wall surface is formed by at least one end wall of the exchangeable frame. In another embodiment of the present invention, the sloping wall surface is provided on the housing portion. In a still further embodiment of the invention, at least one of the inner sides of the end walls of the housing portion is configured as a sloping wall surface. In a preferred embodiment of the invention, the opposite end walls of the exchangeable frame and the inner sides, extending parallel thereto, of the end walls of the housing portion are provided with sloping wall surfaces. A significant advantage of this embodiment is that this shape ensures an attachment of the exchangeable frame to the housing portion either way. This configuration ensures further that the pressure element(s) acted upon by a spring element in one of the end walls is/are moved into abutment with a sloping wall surface in order to then urge the abutment surface of the stop element on the exchangeable frame into engagement with the abutment surface of the stop element on the housing portion and maintain them in engagement.

In relatively simple and low-cost embodiment, the pressure element is mounted for movement in opposition to the pressure of a spring element in only one of the end walls of the exchangeable frame or the housing portion in and against the direction of force of the spring element—direction of arrow A.

According to a very simple and low-cost embodiment, the pressure element is configured as a ball. In an alternative embodiment of the invention, the pressure element is configured as a cylindrical rod. In order to maintain the energy needing to be expended for attaching the exchangeable frame to the housing portion low, an embodiment of the invention provides for the pressure element to be both movably mounted and mounted for rolling motion against the direction of force of the spring element.

In a preferred embodiment of the present invention, a wall for supporting the pressure element is provided parallel to the direction of force of the spring element. Preferably, the pressure element and the spring element are movably held in a guide channel, such that the pressure element is guided in supporting manner by at least one wall of the guide channel.

In a further embodiment of the present invention, the housing portion is configured as part of the housing and is solidly joined together with the housing.

Embodiments of the present invention will be described in the following with reference to the accompanying drawing, in which.

Figure 3:
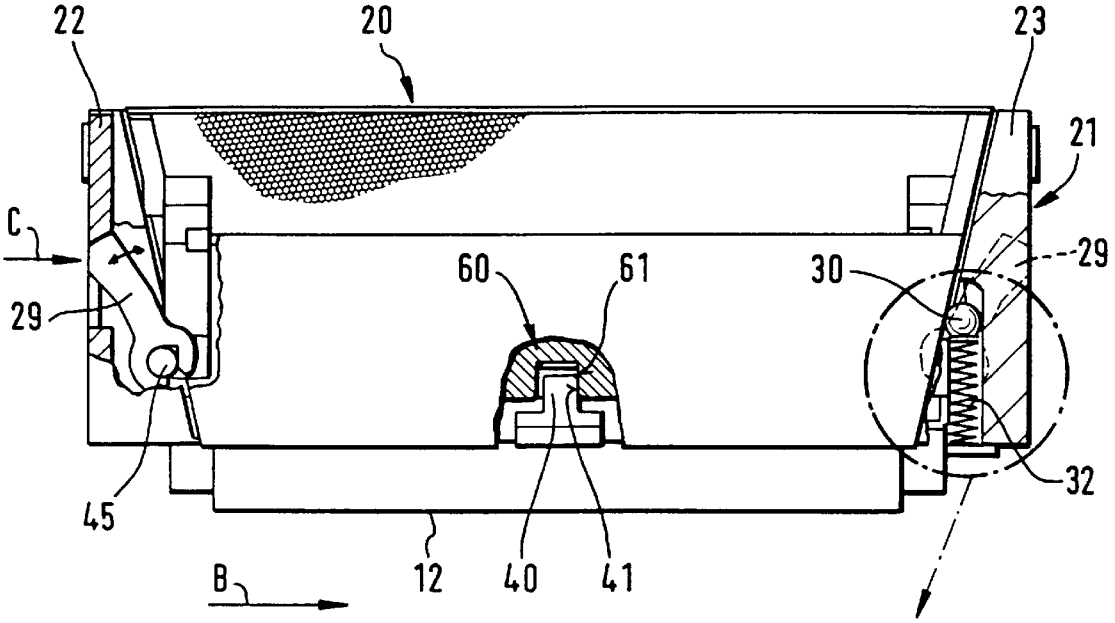
Figure 4:
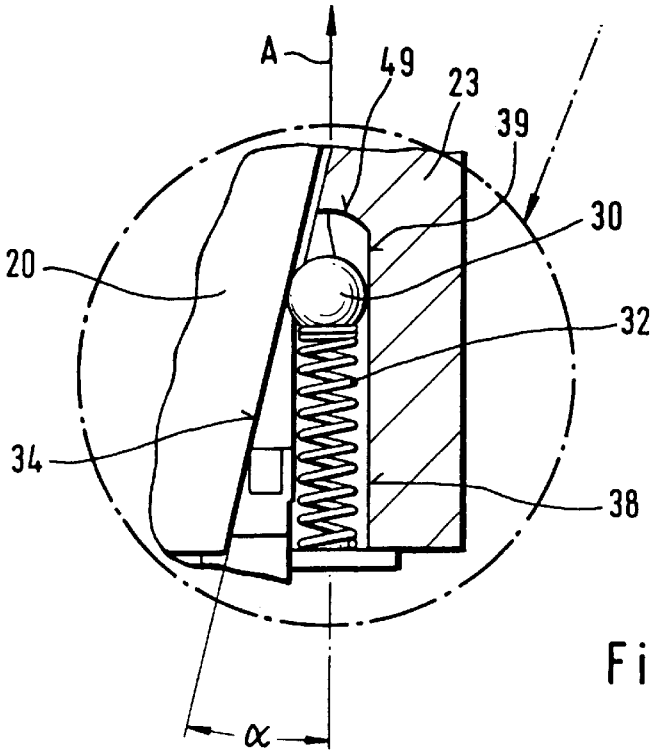

FIG. 3 is a side view of an exchangeable frame and a housing portion, with parts broken away in the area of the latching mechanism between the exchangeable frame and the housing portion, in the area of the stop elements provided on the exchangeable frame and on the housing portion, and in the area of a pressure element resting against a sloping wall surface of the exchangeable frame; and FIG. 4 is a view, on an enlarged scale, of the abutting engagement of a ball mounted on a spring element for rolling motion along a sloping wall surface of an exchangeable frame.

Figure 1:
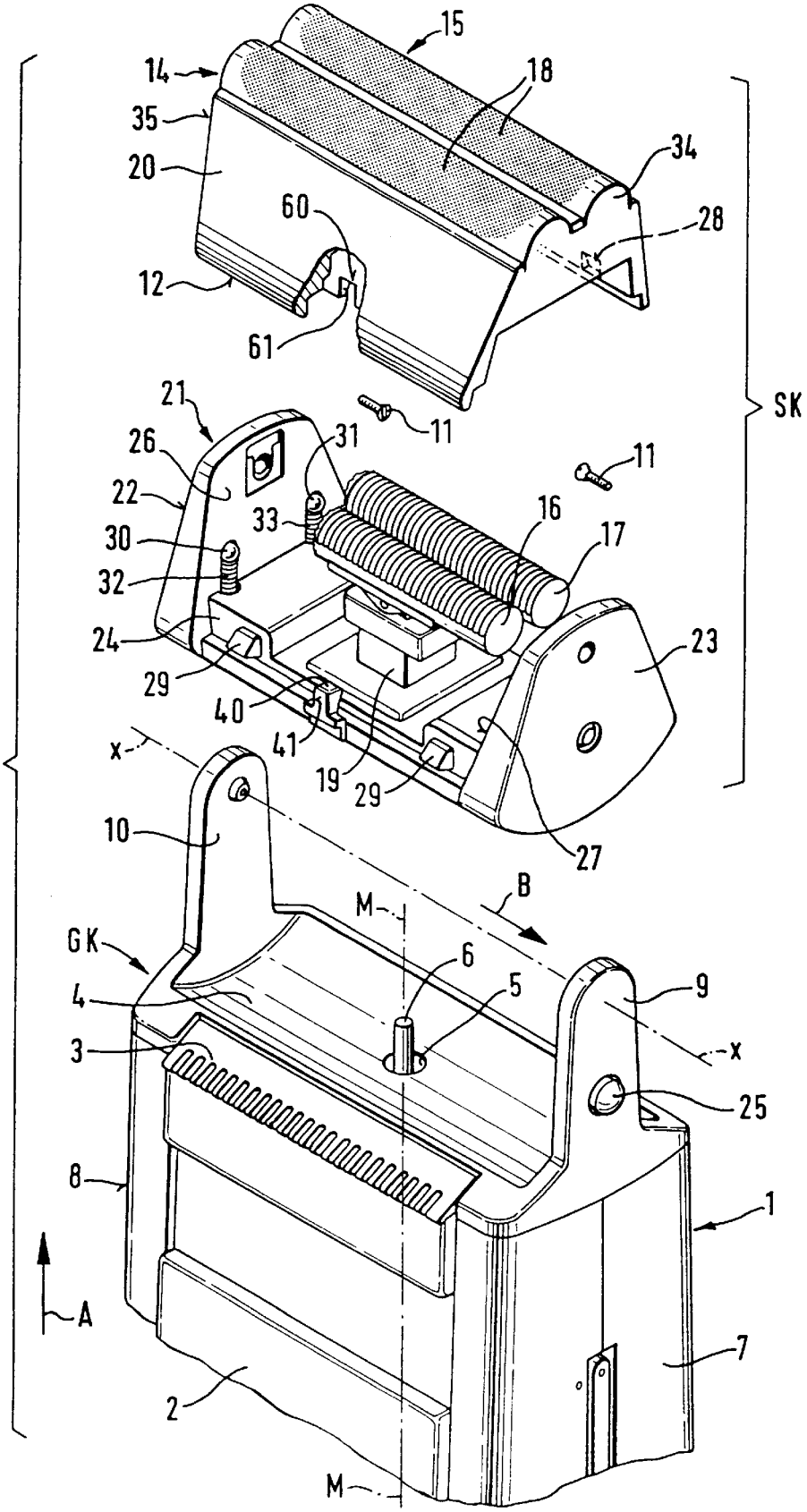
FIG. 1 is a perspective view of the upper part of a dry shaving apparatus showing a shaving head assembly removed therefrom.

In FIG. 1 showing the upper part of a dry shaving apparatus, reference numeral 1 designates the shaver housing, 2 the On/Off switch, 3 the long-hair trimmer, 4 the housing upper side, 6 the drive pin protruding from the opening 5 in the housing upper side 4, reference numerals 9 and 10 identify support arms extending in an extension of housing narrow sides 7 and 8, and SK designates the shaving head assembly mounted for pivotal motion about an axis x—x by means of bearing screws 11. The support arms 9 and 10 are part of a housing head portion GK fabricated from plastic—see FIG. 1—or alternatively are integrally formed with the housing 1.

The shaving head assembly SK shows a pair of shaving heads 14 and 15 in parallel arrangement and comprising two inner cutters 16 and 17 and at least one cutting element 18 embracing said inner cutters 16 and 17 in arched form. The inner cutters 16 and 17 are spring-mounted on a common coupling element 19. The coupling element 19 is coupled with a drive element which is part of an oscillatory bridge structure carried in the housing portion 21. For the purpose of transmitting the driving motion from the drive pin 6 to the oscillatory bridge structure, the latter includes two transverse rib members having a space there-between for engagement with the drive pin 6. When the drive mechanism is activated, the transverse rib members of the oscillatory bridge structure oscillate within the opening provided in a base plate in the housing portion 21 of the shaving head frame.

The housing portion 21 which is of a substantially U-shaped configuration is formed by two opposed end walls 22, 23 and a transverse wall 24 connecting said end walls 22, 23, and it is pivotally mounted in the support arms 9 and 10 by means of two bearing screws 11.

For releasably mounting the exchangeable frame 20 equipped with at least one cutting element 18, the exchangeable frame 20 includes detent means 28 configured as recesses for engagement with detent means 29 spring-mounted in the housing portion 21, there being provided at least two detent means 29 in the housing portion 21 in order to ensure a secure attachment of the exchangeable frame 20 to the housing portion 21, said detent means being engageable with registering recesses forming the detent means 28 on the exchangeable frame 20.

In the embodiment of FIG. 1, for example, four detent means 29—of which two can be seen in the drawing—are arranged in the transverse wall 24 of the housing portion 21 for movement transverse to the direction in which the axis x—x extends, with a spring—not shown—being disposed between each two oppositely mounted detent means 29. Spring-mounted in the support arm 9 is, for example, an actuator element 25, such that the application of pressure on the actuator element 25 effects a displacement of a control element via the actuating element 25 in opposition to the direction of arrow B in the end wall 2, of the housing portion 21, whereby control cams provided on the control element move the opposite detent means 29 into the interior of the transverse wall 24, thereby unlatching the exchangeable frame 20 and releasing it for removal.

In the embodiment of FIG. 1, two pressure elements 30 and 31 which are configured as balls projecting a small amount from the sloping end wall 22 are mounted on springs in addition to being mounted for rolling motion against the pressure of spring elements 32 and 33 on the inner side 26 of the end wall 22 of the housing portion 21. When the exchangeable frame 20 is placed down onto the housing portion 21, the pressure elements 30 and 31 make engagement with one of the two sloping wall surfaces 34 or 35 provided at the ends of the exchangeable frame 20, said pressure elements rolling, during the process of attaching the exchangeable frame 20 to the housing portion 21, along the sloping wall surface 34 or 35 on the one side, and along a wall 39 of a guide channel 38 on the other side until the operation of latching the exchangeable frame 20 with the housing portion 21 is completed. As this occurs, the sloping wall surface 34 or 35 exerts a pressure on the pressure elements 30, 31 resting against the wall 39—see FIG. 4, compressing the spring elements 32 and 33 against their direction of force by an amount meeting the requirements of practice.

Provided on the transverse wall 24 of the housing portion 21 is at least one stop element 40 having an abutment surface 41. This stop element 40 cooperates with a stop element 60 having an abutment surface 61 and provided in the longitudinal side 12 of the exchangeable frame 20. While the stop element 40 is configured, for example, as a rib structure, the stop element 60 is, for example, a U-shaped recess embracing the rib structure. The relative distance of the two U-shaped legs of the stop element 60 is slightly larger than the thickness of the rib structure forming the stop element 40. On seating the exchangeable frame 20 down onto the housing portion 21, the exchangeable frame 20 is guided partly via its sloping wall surfaces 34 and 35 by the equally sloping wall surfaces on the inner sides 26 and 27 of the end walls 22 and 23 of the housing portion 21, until the detent means 29 of the housing portion 21 lock into the detent means 28 provided in the exchangeable frame 20. During this process of mounting the exchangeable frame 20, the U-shaped recess of the stop element 60 glides over the rib structure of the stop element 40. As this engaging motion proceeds, the pressure elements 30 and 31 make engagement with the sloping wall surface 35 of the exchangeable frame 20, being moved by the sloping wall surface 35 against the pressure of the spring elements 32 and 33 in the direction of the housing 1—in opposition to the direction of arrow A. During this process, the pressure elements 30 and 31 configured as balls roll off along the sloping wall surface 35. Due to the angle $\alpha$ defined between the sloping wall surface 35 and the vertical center line M, and the change of position of the pressure elements 30 and 31 against the pressure of the spring elements 32 and 33, in the embodiment of FIG. 1 the exchangeable frame 20 is moved in the direction of arrow B, causing the abutment surface 61 of the stop element 60 to make engagement with the abutment surface 41 of the stop element 40. The angle $\alpha$ of the sloping wall surface 35 as well as the spring force of the spring elements 32 and 33 are dimensioned such that the relative engagement of the abutment surfaces 41 and 62 is capable of withstanding any loads to which the shaving head assembly is exposed in the course of use of the dry shaving apparatus, thus compensating for any wear which the locking engagement of the exchangeable frame 20 with the housing portion 21 suffers, utilizing the spring force of the spring elements 32 and 33.

Differing from the embodiment of FIG. 1, the engagement function of the abutment surface 61 of the U-shaped recess forming the stop element 60 on the exchangeable frame 20 with the abutment surface of the rib-type stop element 40 on the housing portion 21 is furthermore ensured by the arrangement of only one pressure element 30 acted upon by a spring element 32 on the inner side 26 of the end wall 22 of the housing portion 21, not shown, which pressure element may also be configured as a cylindrical rod, for example.

Figure 2:
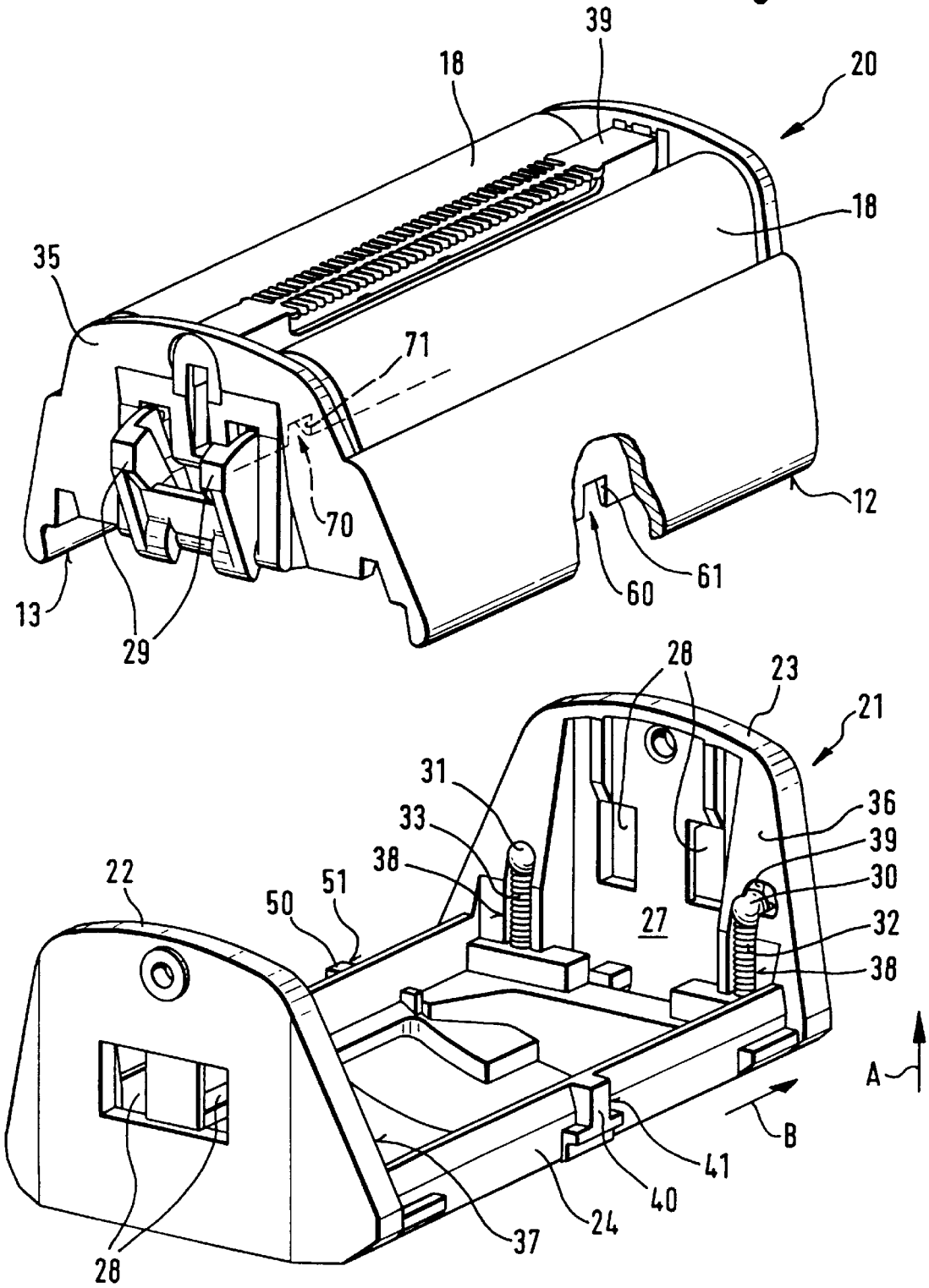
FIG. 2 is a perspective view of a housing portion showing an exchangeable frame removed.

FIG. 2 is a perspective view of an exchangeable frame 20 and a housing portion 21 having detent means 28 in the ends of the housing portion 21 to receive therein the detent means 29 provided on either end of the exchangeable frame 20, of which however only one latch element 29 can be seen in the Figure.

Provided on the transverse wall 24 are two stop elements 40 and 50 having each a respective abutment surface 41 and 51 associated with the pressure elements 30 and 31. The pressure elements 30 and 31 are movably arranged only in the inner side 27 of the end wall 23 in a guide channel 38 and are held, for example, by means of a wall 49 extending in the direction of arrow A—see FIG. 4. The inner sides 26 and 27 of the end walls 22 and 23 as well as the outer end walls of the exchangeable frame 20 are at least partly configured as corresponding, parallel wall surfaces, one of these wall surfaces being a sloping wall surface 34, 35, 36, 37 at least over a partial area thereof. In the embodiment of FIG. 1, substantially the entire surface of the inner sides 26 and 27 of the end walls 22 and 23 is of a sloping configuration. Equally, the opposite outer end walls of the exchangeable frame 20 are of a sloping configuration.

The exchangeable frame 20 of FIG. 2 corresponds in its structure to the exchangeable frame of FIG. 1, with the exception that it has a respective detent means 29 spring-mounted in the sloping wall surfaces 34, 35 of the outer end walls. When the exchangeable frame 20 is seated down onto the housing portion 21, the detent means 29 locks into the respective detent means 28 provided in the end walls 22, 23, unlocking being effected by actuation from outside—see FIG. 3—in the direction of arrow C.

FIG. 3 shows the housing portion 21 in a condition attached to an exchangeable frame 20. The two detent means 29 provided on the exchangeable frame 20 are in engagement with the detent means 28 provided in the end walls 22 and 23. By breaking away part of the longitudinal side wall of the exchangeable frame 20 and the end wall 22 of the housing portion 21, the detent means 29 pivotally mounted about a bearing axis 45 is exposed to view. By exerting pressure from outside in the direction of arrow C, the detent means 29 can be swung out of the detent means 28 to an unlocked position, enabling the exchangeable frame 20 to be withdrawn from the housing portion 21.

Referring to the enlarged view of FIG. 4 in which part of the end wall 23 is broken away, there will be described in more detail the arrangement and configuration of the pressure device acting on a sloping surface on the exchangeable frame 20 and by means of which an abutment surface provided on the exchangeable frame 20 is moved toward and maintained in engagement with a further abutment surface 41, 51 provided on the housing portion 21.

FIG. 4 shows part of the end wall 23 with a guide channel 38, a spring element 32 resting with one end against the bottom of the guide channel 38 and carrying on its other end a pressure element 30 configured, for example, as a ball for rolling motion. The pressure element 30 has its spherical outer wall in engagement with the sloping wall surface 34 of the exchangeable frame 20.

With the exchangeable frame 20 unseated, the pressure element 30, acted upon by a low force from the spring element 32, is in engagement with a wall 49 at the end remote from the bottom, and as the operation of attaching the exchangeable frame 20 to the housing portion 21 proceeds, it is moved against the spring element 32 in opposition to the direction of arrow A. This spring tension of the spring element 32 operates to urge the pressure element 30, which bears against the wall 39, against the sloping wall surface 34, hence moving the exchangeable frame 20 against the direction of arrow B until the abutment surfaces 61 and 71 of the stop elements 60 and 70 on the exchangeable frame make engagement with the abutment surfaces 41 and 51 of the stop elements 40 and 50. The tension force of the spring element 32 or—in the event of two spring elements 32 and two pressure elements 30, 31 being provided—of the spring elements 32, and the direction in which the sloping wall surface 34, 35, 36, 37 extends relative to the direction of force of the spring element 32, which is oriented parallel to the vertical center line M of the dry shaving apparatus and is defined in greater detail by the angular range α, are relatively coordinated, such that an engagement of the abutment surfaces 61 and 71 of the stop elements 60 and 70 with the abutment surfaces 40 and 51 of the stop elements 40 and 50 is at all times ensured during operation of the dry shaving apparatus.

What is claimed is:

1. A dry shaving apparatus comprising:

a housing;

a housing portion mounted on the housing and having a first inner wall and a second inner wall opposite the first end wall;

a biasing mechanism including a pressure element, a spring element, and a bearing wall;

at least one exchangeable frame incorporating at least one cutting element and having a first end wall on one end and a second end wall on an opposite end, one of said first inner wall and said first end wall defining a sloping wall surface; and at least one detent element holding the exchangeable frame onto the housing portion so that said first end wall abuts said first wall and said second end wall abuts said second wall, said frame having a first stop element that cooperates with a corresponding second stop element of the housing portion, wherein the first and second stop elements are maintained in engagement with each other by said spring element acting upon said pressure element and causing said pressure element to both bear against said bearing wall and act upon said sloping wall surface, and wherein said spring element has a direction of force and the sloping wall surface slopes with respect to a plane that is normal to the direction of force.

2. The dry shaving apparatus as claimed in claim 1, wherein the housing portion also has a transverse wall, and wherein the second stop element is provided on the transverse wall.

3. The dry shaving apparatus as claimed in claim 1, wherein the exchangeable frame also has a longitudinal side, and wherein the first stop element is provided on the longitudinal side.

4. The dry shaving apparatus as claimed in claim 1, wherein the first and second stop elements have abutment surfaces extending parallel to the direction of force of the spring element.

5. The dry shaving apparatus as claimed in 1, wherein the housing defines a vertical center line, the direction of the force of the spring element being oriented parallel to the vertical center line.

6. The dry shaving apparatus as claimed in claim 1, wherein the sloping wall surface extends at an angle α of between 3° and 45° relative to the direction of force of the spring element.

7. The dry shaving apparatus as claimed in claim 6, wherein the angle α is in an angular range of 15°±5°.

8. The dry shaving apparatus as claimed in claim 1, wherein the pressure element is provided in one of the first inner wall and the first end wall.

9. The dry shaving apparatus as claimed in claim 1, further comprising:

a second pressure element and a respective second spring element acting on the second pressure element, said second pressure element and second spring element being provided in the first inner wall of the housing portion.

10. The dry shaving apparatus as claimed in claim 1, wherein the first mentioned and second pressure elements and the first mentioned and second spring elements are arranged in the first inner wall of the housing portion.

11. The dry shaving apparatus as claimed in claims 1 or 9, wherein the first mentioned pressure element is provided in the sloping wall surface.

12. The dry shaving apparatus as claimed in claim 5, wherein the sloping wall surface is defined by the first end wall provided on the exchangeable frame.

13. The dry shaving apparatus as claimed in claim 1, wherein the sloping wall surface being formed by the first end wall of the exchangeable frame.

14. The dry shaving apparatus as claimed in claim 5, wherein the first inner wall defines the sloping wall surface.

15. The dry shaving apparatus as claimed in claim 5, wherein the first inner wall and first end wall are parallel to each other and define sloping surfaces relative to the plane that is normal to the direction of force, and wherein the second inner wall and second end wall are parallel to each other and define sloping surfaces relative to the plane that is normal to the direction of force s and the first and second end walls.

16. The dry shaving apparatus as claimed in claim 1, wherein the pressure element is mounted in the first end wall for movement in opposition to a force supplied by the spring element.

17. The dry shaving apparatus as claimed in claim 1, wherein the pressure element is a ball.

18. The dry shaving apparatus as claimed in claim 1, wherein the pressure element is both movably mounted and mounted for rolling motion against the direction of force of the spring element.

19. The dry shaving apparatus as claimed in claim 1, wherein a recessed first wall for supporting the pressure element is provided parallel to the direction of force of the spring element.

20. The dry shaving apparatus as claimed in claim 1, wherein one of the first inner wall and the first end wall has a guide channel formed therein, said guide channel having a first recessed wall, and wherein the pressure element and the spring element are movably held in the guide channel, such that the pressure element is guided in supporting manner by the first recessed wall.

* * * * *